US011281140B2

(12) United States Patent
Gon et al.

(10) Patent No.: US 11,281,140 B2
(45) Date of Patent: Mar. 22, 2022

(54) FIXING DEVICE AND IMAGE FORMING APPARATUS

(71) Applicant: KYOCERA Document Solutions Inc., Osaka (JP)

(72) Inventors: Shoko Gon, Osaka (JP); Kuniaki Nakano, Osaka (JP)

(73) Assignee: KYOCERA DOCUMENT SOLUTIONS INC., Osaka (JP)

( * ) Notice: Subject to any disclaimer, the term of this patent is extended or adjusted under 35 U.S.C. 154(b) by 0 days.

(21) Appl. No.: 17/157,333

(22) Filed: Jan. 25, 2021

(65) Prior Publication Data

US 2021/0240117 A1 Aug. 5, 2021

(30) Foreign Application Priority Data

Jan. 31, 2020 (JP) ..... JP2020-014874

(51) Int. Cl.
*G03G 15/20* (2006.01)

(52) U.S. Cl.
CPC ..... *G03G 15/2053* (2013.01); *G03G 15/2064* (2013.01); *G03G 2215/2038* (2013.01)

(58) Field of Classification Search
CPC ..... G03G 15/2053; G03G 15/2064; G03G 2215/2038
See application file for complete search history.

(56) References Cited

FOREIGN PATENT DOCUMENTS

JP 2017-062442 A 3/2017

*Primary Examiner* — Hoang X Ngo
(74) *Attorney, Agent, or Firm* — Stein IP, LLC

(57) ABSTRACT

A fixing device includes an endless fixing belt, a belt guide, and a frame member. The belt guide has a fastening portion, an arc portion, and a contact portion. The fastening portion is fastened to the frame member. The arc portion extends from the fastening portion while curving in an arc shape along the inner circumferential face of the fixing belt and has an elastic force acting outward in the radial direction. The contact portion extends from one end of the arc portion in the circumferential direction toward the frame member and has a counter-face facing the inner circumferential face of the arc portion. The frame member has a regulating portion that extends toward the belt guide to make surface contact with, so as to overlap, the counter-face of the contact portion.

5 Claims, 5 Drawing Sheets

FIXING DEVICE AND IMAGE FORMING APPARATUS

INCORPORATION BY REFERENCE

This application is based on and claims the benefit of Japanese Patent Application No. 2020-014874 filed on Jan. 31, 2020, the contents of which are hereby incorporated by reference.

BACKGROUND

The present disclosure relates to a fixing device, and to an image forming apparatus incorporating a fixing device.

Electrophotographic image forming apparatuses such as copiers and printers widely employ thermal fixing as a method for fixing an unfixed toner image transferred to a recording medium such as paper to the paper. The recording medium passes through a fixing nip portion where a fastening member and a pressing member make contact with each other, and is meanwhile pressed and heated so that the unfixed toner image is fixed. A known method uses as a fastening member a fixing belt configured as an endless belt.

For example, a known fixing device includes an endless fixing belt, a heating portion disposed outward of the fixing belt in the radial direction, a belt guide member disposed inward of the fixing belt in the radial direction and having an arc-shaped portion bulging toward the heating portion, and a fastening member to which opposite end parts, in the circumferential direction, of the arc-shaped portion of the belt guide member are fitted. The belt guide member is, at one end of it in the circumferential direction of the arc-shaped portion, fastened to the fastening member with bolts. The belt guide member is, at the other end of it in the circumferential direction of the arc-shaped portion, connected to an adjusting member provided on the fastening member for adjustment of the bulge of the arc-shaped portion toward the heating portion. This permits accurate adjustment of the gap distance between the fixing belt and the heating portion.

SUMMARY

According to one aspect of the present disclosure, a fixing device includes an endless fixing belt, a pressing member, a nip forming member, a belt guide, and a frame member. The endless fixing belt is rotatable along the conveying direction of a recording medium. The pressing member makes contact with the outer circumferential face of the fixing belt to give the fixing belt a rotating driving force. The nip forming member is disposed inward of the fixing belt so as to face the pressing member across the fixing belt, and makes contact with the inner circumferential face of the fixing belt to form a fixing nip portion. The belt guide makes contact with the inner circumferential face of the fixing belt at other than the nip portion to support the fixing belt from inward. The frame member holds the nip forming member and the belt guide. The belt guide has a fastening portion, an arc portion, and a contact portion. The fastening portion is fastened to the frame member at one side of the fixing nip portion in the belt rotation direction. The arc portion extends from the fastening portion while curving in an arc shape along the inner circumferential face of the fixing belt, and has an elastic force acting outward in the radial direction. The contact portion extends from one end of the arc portion in the circumferential direction at the other side of the fixing nip portion in the belt rotation direction toward the frame member, and has a counter-face that faces the inner circumferential face of the arc portion. The frame member has a regulating portion that extends toward the belt guide to make surface contact with, so as to overlap, the counter-face of the contact portion.

DETAILED DESCRIPTION

Hereinafter, an embodiment of the present disclosure will be described with reference to the accompanying drawings. The following is not in any way meant to limit the scope of the present disclosure.

Figure 1:
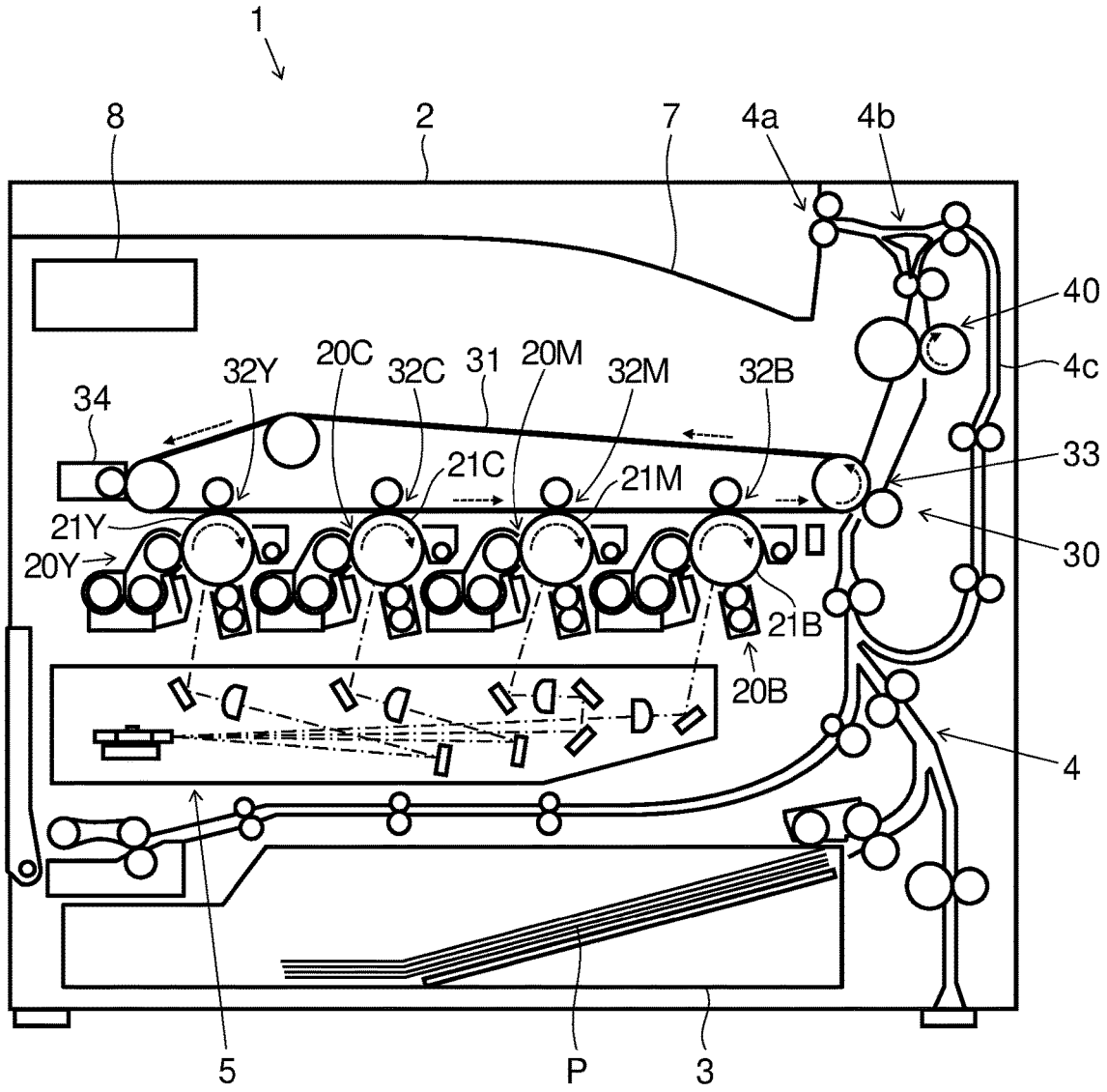
FIG. 1 is a schematic sectional front view showing a construction of an image forming apparatus according to an embodiment of the present disclosure.

FIG. 1 is a schematic sectional view showing a construction of an image forming apparatus 1 according to an embodiment. One example of the image forming apparatus 1 of this embodiment is a tandem-type color printer that transfers a toner image to a sheet P by using an intermediate transfer belt 31. The image forming apparatus 1 can be what is called a multifunction peripheral provided with the functions of, for example, printing (image forming), scanning (image reading), and facsimile transmission.

As shown in FIG. 1, the image forming apparatus 1 includes, as components housed in a body casing 2, a sheet feeding portion 3, a sheet conveying portion 4, an exposure portion 5, an image forming portion 20, a transfer portion 30, a fixing device 40, a sheet discharge portion 7, and a controller 8.

The sheet feeding portion 3 stores a plurality of sheets P (recording medium), and during printing feeds out the sheets P one by one separately. The sheet conveying portion 4 conveys the sheet P fed out from sheet feeding portion 3 to a secondary transfer portion 33 and then to the fixing device 40, and further discharges the sheet P after fixing via a sheet discharge port 4*a* into a sheet discharge portion 7. When duplex printing is performed, the sheet conveying portion 4 distributes, by using a branch portion 4*b*, the sheet P having one side fixed into a reverse conveying portion 4*c* and then conveys the sheet P once again to the secondary transfer portion 33 and then to the fixing device 40. The exposure portion 5 shines laser light controlled based on image data toward the image forming portion 20.

The image forming portion 20 is disposed under the intermediate transfer belt 31. The image forming portion 20 comprises an image forming portion 20Y for yellow, an image forming portion 20C for cyan, an image forming portion 20M for magenta, and an image forming portion 20B for black. These four image forming portions 20 basically has the same structure. Accordingly, in the following description, unless distinction is necessary, the suffixes "Y", "C", "M", and "B" distinguishing different colors will sometimes be omitted.

The image forming portion 20 includes a photosensitive drum 21, which is an image carrying member supported so as to be rotatable in a predetermined direction (in FIG. 1, clockwise). The image forming portion 20 further includes, around the photosensitive drum 21 along its rotation direction, a charging portion, a developing portion, and a drum cleaning portion. Between the developing portion and the drum cleaning portion, a primary transfer portion 32 is disposed.

The charging portion electrostatically charges the outer circumferential face of the photosensitive drum 21 to a predetermined potential. The laser light emitted from the exposure portion 5 forms an electrostatic latent image of a document image on the outer circumferential face of the photosensitive drum 21. The developing portion attaches toner to the electrostatic latent image to develop it and thereby forms a toner image. The four image forming portions 20 each form a toner image of a different color.

The transfer portion 30 includes the intermediate transfer belt 31, primary transfer portions 32Y, 32C, 32M and 32B, the secondary transfer portion 33, and a belt cleaning portion 34. The intermediate transfer belt 31 is disposed over the four image forming portions 20. The intermediate transfer belt 31 is an intermediate transfer member that is supported so as to be rotatable in a predetermined direction (in FIG. 1, counter-clockwise) and to which the toner images formed respectively in the four image forming portions 20 are primarily transferred sequentially while being overlaid on each other. The four image forming portions 20 are disposed in what is called a tandem formation where they are disposed in a row from upstream to downstream in the rotation direction of the intermediate transfer belt 31.

The primary transfer portions 32Y, 32C, 32M and 32B are disposed above the image forming portions 20Y, 20C, 20M, and 20B for the different colors, with the intermediate transfer belt 31 in between. The secondary transfer portion 33 is disposed in the sheet conveying portion 4, upstream of the fixing device 40 in the sheet conveying direction, downstream of the image forming portions 20Y, 20C, 20M, and 20B for the different color in the rotation direction of the intermediate transfer belt 31. The belt cleaning portion 34 is disposed upstream of the image forming portions 20Y, 20C, 20M, and 20B for the different color in the rotation direction of the intermediate transfer belt 31.

The toner images are, in the primary transfer portions 32Y, 32C, 32M and 32B for the different colors, primarily transferred to the outer circumferential face of the intermediate transfer belt 31. As the intermediate transfer belt 31 rotates, the toner images formed in the four image forming portions 20 are transferred sequentially, with predetermined timing so as to be laid on each other, to the intermediate transfer belt 31. In this way, a color toner image having toner images of four colors, namely yellow, cyan, magenta, and black, laid on each other is formed on the outer circumferential face of the intermediate transfer belt 31. The drum cleaning portion cleans the outer circumferential face of the photosensitive drum 21 by removing toner and the like that are left behind there after primary transfer.

The color toner image on the outer circumferential face of the intermediate transfer belt 31 is, at the secondary transfer nip portion formed in the secondary transfer portion 33, transferred to a sheet P conveyed there in a synchronized manner by the sheet conveying portion 4. The belt cleaning portion 34 cleans the outer circumferential face of the intermediate transfer belt 31 by removing toner and the like that are left behind there after secondary transfer.

The fixing device 40 presses and heats the sheet P having the toner image transferred to it so as to fix the toner image to the sheet P.

The controller 8 includes, though none of the following is illustrated, a CPU, an image processor, a storage, and other electronic circuits and components. The CPU controls the operation of different components provided in the image forming apparatus 1 based on control programs and data stored in the storage, thereby to carry out the functions of the image forming apparatus 1. The sheet feeding portion 3, the sheet conveying portion 4, the exposure portion 5, the image forming portion 20, the transfer portion 30, and the fixing device 40 individually receive instructions from the controller 8, to operate in a coordinated manner to perform printing on the sheet P. The storage is configured as a combination of, for example, nonvolatile storage devices such as a program ROM (read-only memory) and a data ROM and volatile storage devices such as a RAM (random-access memory).

Figure 2:
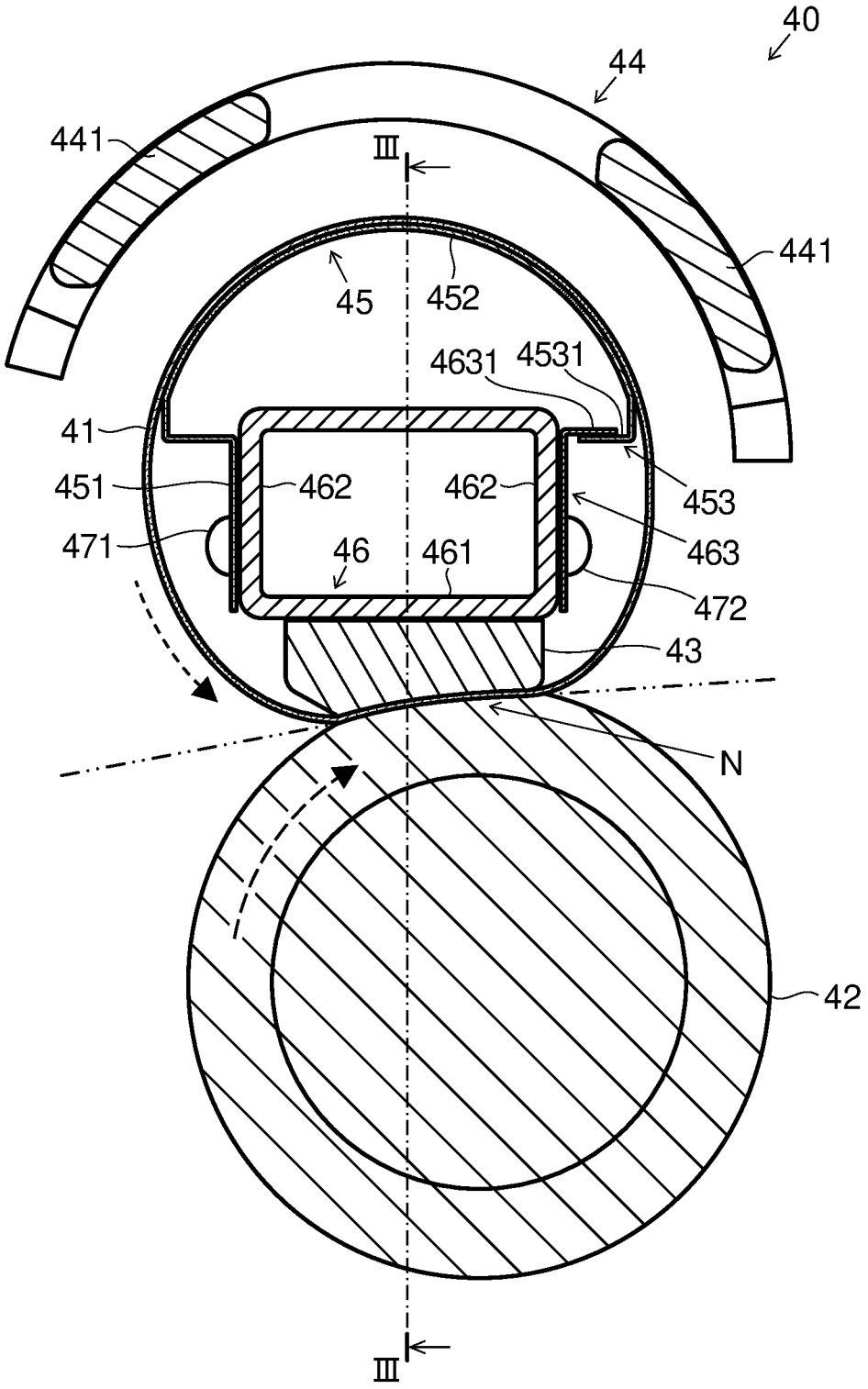
FIG. 2 is a sectional front view of a fixing device according to the embodiment of the present disclosure.
Figure 3:
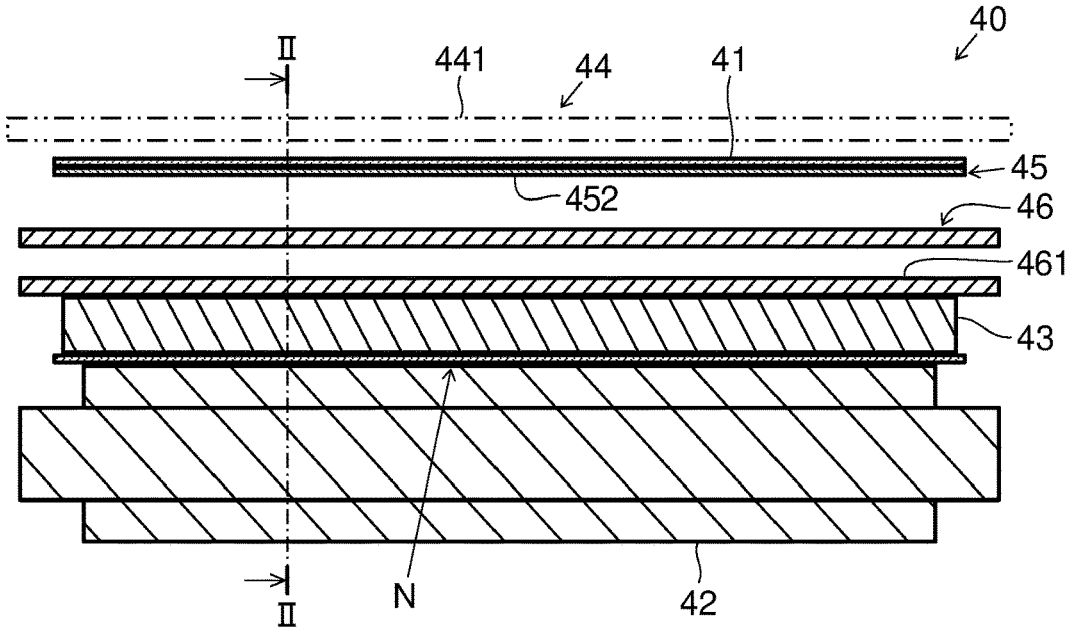
FIG. 3 is a side view of a sectional end face of the fixing device according to the embodiment of the present disclosure.
Figure 4:
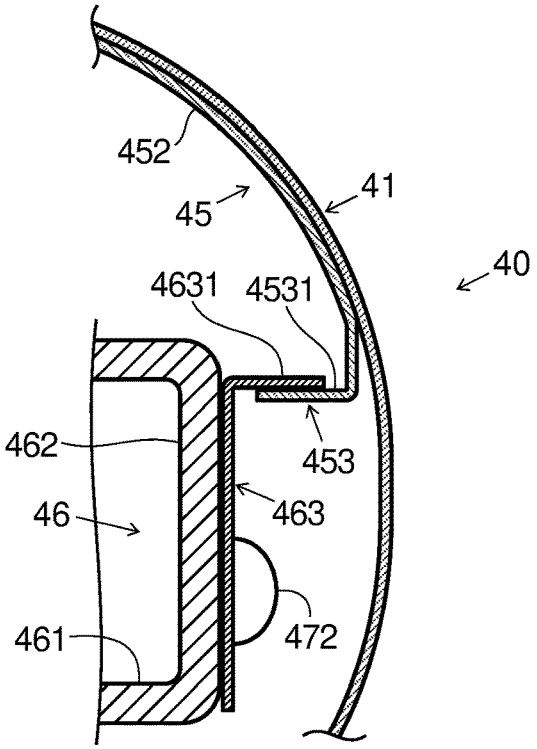
FIG. 4 is a partly sectional front view of the fixing device according to the embodiment of the present disclosure.

Next, the structure of the fixing device 40 according to the embodiment will be described with reference to FIGS. 2, 3, and 4. FIG. 2 is a sectional front view of the fixing device 40 according to the embodiment. FIG. 3 is a side view of a sectional end face of the fixing device 40 according to the embodiment. FIG. 4 is a partly sectional front view of the fixing device 40 according to the embodiment.

FIGS. 2, 3, and 4 show, for the sake of convenience, a structure where, relative to the fixing nip portion N, a fixing belt 41 is disposed above and a pressing roller 42 (pressing member) is disposed below. In FIG. 2, the left side corresponds to the upstream side in the sheet conveying direction with respect to the fixing device 40 and the right side corresponds to the downstream side in the sheet conveying direction with respect to the fixing device 40. FIG. 2 is a sectional view along line in FIG. 3, and FIG. 3 is a sectional end face view along line III-III in FIG. 2. FIG. 4 is a partial sectional view resulting from enlarging a part of FIG. 2, where the components other than the fixing belt 41, a belt guide 45, and a frame member 46 are omitted from illustration.

As shown in FIGS. 2 and 3, the fixing device 40 includes the fixing belt 41, the pressing roller 42 (pressing member), a nip forming member 43, a heating portion 44, a belt guide 45, and a frame member 46.

The fixing belt 41 is supported on a housing portion of the fixing device 40 so as to be rotatable about a horizontal axis. The fixing belt 41 is endless, is configured in a cylindrical shape with an outer diameter of, for example 20 mm to 50 mm, and has approximately the same length as the pressing roller 42 in the rotation axis direction (the width direction perpendicular to the conveying direction of the sheet P). The fixing belt 41 can rotate along the conveying direction of the sheet P as a recording medium.

The fixing belt 41 has a layered structure in which an elastic layer and a release layer are provided on the outer side of a heating layer as a base layer. The heating layer is formed of, for example, a film of metal such as nickel with a thickness of 30 μm to 50 μm or a film of polyimide with a thickness of 50 μm to 100 μm having powder of metal such as copper, silver, or aluminum mixed to it. The elastic layer is formed of, for example, silicone rubber or the like with a thickness of 100 μm to 500 μm. The release layer is formed of, for example, a fluorocarbon polymer such as PFA (tetrafluoroethylene-perfluoroalkyl vinyl ether copolymer) with a thickness of 30 μm to 50 μm.

The pressing roller 42 is supported on the housing portion of the fixing device 40 so as to be rotatable about a horizontal axis. The pressing roller 42 is configured in a cylindrical shape, and has approximately the same length as the fixing belt 41 in the rotation axis direction (the width direction of the sheet P). To the pressing roller 42, a pressing mechanism (not illustrated) exerts a predetermined pressure toward the fixing belt 41. The outer circumferential face of the pressing roller 42 presses against the nip forming member 43 with the fixing belt 41 in between, and makes contact with the outer circumferential face of the fixing belt 41 to form the fixing nip portion N.

The pressing roller 42 is coupled to a driving source (not illustrated) including a motor; thus the pressing roller 42 receives motive power from the motor to rotate clockwise in FIG. 2. The pressing roller 42 makes contact with the outer circumferential face of the fixing belt 41, and gives the fixing belt 41 a rotating driving force.

The pressing roller 42 has a layered structure in which an elastic layer and a release layer are provided on the outer side of a metal base. The metal base is formed of, for example, metal such as aluminum with a diameter of about 20 mm. The elastic layer is formed of, for example, silicone rubber with a thickness of about 3 mm to 8 mm. The release layer is formed of, for example, a fluorocarbon polymer such as PFA with a thickness of about 10 μm to 50 μm.

The nip forming member 43 is disposed inward of the fixing belt 41, so as to face the pressing roller 42 across the fixing belt 41. The nip forming member 43 makes contact with the inner outer circumferential face of the fixing belt 41, and forms the fixing nip portion N between the fixing belt 41 and the pressing roller 42.

The nip forming member 43 has a substantially rectangular shape extending in the rotation axis direction of the fixing belt 41 (the sheet width direction) over approximately the same length as the fixing belt 41. The nip forming member 43 has a base member formed of, for example, metal such as aluminum or heat-resistant resin such as a liquid crystal polymer. The nip forming member 43 may have, at the side of the base member facing the fixing belt 41, an elastic layer formed of, for example, elastomer, silicone rubber, or the like. The nip forming member 43 further has, in a region facing the fixing belt 41, a sheet member (release layer) formed of a fluorocarbon polymer such as PFA. The sheet member makes contact with the inner circumferential face at the fixing nip portion N, and extends up to regions upstream and downstream of the fixing nip portion N in the rotation direction of the fixing belt 41, in which regions the sheet member does not make contact with the fixing belt 41.

The heating portion 44 is disposed in a region at the side of the fixing belt 41 opposite from where the pressing roller 42 is disposed, so as to face the outer circumferential face of the fixing belt 41 across a predetermined gap. The heating portion 44 extends in the rotation axis direction of the fixing belt 41 (the sheet width direction) beyond the fixing belt 41 and the belt guide 45.

The heating portion 44 includes an exciting coil 441, a holding member (not illustrated), a core, and the like. The exciting coil 441 and the core are held at predetermined positions by the holding member. The exciting coil 441 is formed of litz wire composed of a plurality of strands of electrically conductive wire, and is wound so as to extend in the rotation axis direction of the fixing belt 41 (the sheet width direction). The exciting coil 441 is configured in an arc-shape along the outer circumferential face of the fixing belt 41 in the circumferential direction of the fixing belt 41.

The heating portion 44 heats the fixing belt 41 by electromagnetic induction. More specifically, the heating portion 44 makes, by induction heating, the heating layer in the fixing belt 41 to generate heat, and thereby heats the fixing belt 41.

The belt guide 45 is disposed inward of the fixing belt 41, so as to face the heating portion 44 across the fixing belt 41. The belt guide 45 makes contact with the inner circumferential face of the fixing belt 41 at other than the fixing nip portion N, and supports the fixing belt 41 from inward. The belt guide 45 is formed of sheet metal that extends in the rotation axis direction of the fixing belt 41 (the sheet width direction) over approximately the same length as the fixing belt 41. The belt guide 45 is formed of, for example, elastic magnetic metal such as SUS430 with a thickness of 0.1 mm to 0.5 mm.

The belt guide 45 includes a fastening portion 451, an arc portion 452, and a contact portion 453.

The fastening portion 451 is disposed downstream of the arc portion 452 in the rotation direction of the fixing belt 41, upstream of the fixing nip portion N in the belt rotation direction. The fastening portion 451 bends from one end of the arc portion 452 in the circumferential direction to extend inward of the fixing belt 41 in the radial direction, and bends near the frame member 46 to extend toward the fixing nip portion N.

The fastening portion 451 is, at one side of the fixing nip portion N in the belt rotation direction (in this embodiment, upstream of the fixing nip portion N in the belt rotation direction), fastened to the frame member 46. More specifically, the fastening portion 451 is fastened, with a screw 471, to the outer face of a side wall portion 462 of the frame member 46.

The arc portion 452 is disposed at the side opposite from the fixing nip portion N across a central part of the fixing belt 41 in the radial direction. The arc portion 452 extends from the fastening portion 451 in an arc shape along the inner circumferential face of the fixing belt 41. The arc portion 452 has an elastic force that acts outward in the radial direction. The arc portion 452 over its entire region makes contact with the inner circumferential face of the fixing belt 41. The arc portion 452 faces the exciting coil 441 across the fixing belt 41.

The contact portion 453 is disposed upstream of the arc portion 452 in the rotation direction of the fixing belt 41, downstream of the fixing nip portion N in the belt rotation direction. The contact portion 453 bends from one end of the arc portion 452 inward of the fixing belt 41 in the radial direction toward the frame member 46, and extends up to near the frame member 46.

The contact portion 453 extends from one end of the arc portion 452 in the circumferential direction at the other side of the fixing nip portion N in the belt rotation direction (in this embodiment, the downstream side of the fixing nip portion N in the belt rotation direction) toward the frame member 46. The contact portion 453 has a counter-face 4531 that faces the inner circumferential face of the arc portion 452.

The frame member 46 is disposed in an approximately central part of the fixing belt 41 in the radial direction, between the nip forming member 43 and the arc portion 452 of the belt guide 45. The frame member 46 extends along the rotation axis direction of the fixing belt 41 (the sheet width direction) beyond the fixing belt 41.

The frame member 46 holds the nip forming member 43 and the belt guide 45. The nip forming member 43 is fastened to a nip facing wall portion 461 of the frame member 46 that faces the fixing nip portion N. The belt guide 45 is fastened to a side wall portion 462 upstream of the fixing nip portion N in the rotation direction of the fixing belt 41.

The frame member 46 has a regulating portion 463. The regulating portion 463 is fastened, with a screw 472, to the outer face of the side wall portion 462 downstream of the fixing nip portion N in the rotation direction of the fixing belt 41. The regulating portion 463 is configured, for example, in an L-shape as seen from the rotation axis direction of the fixing belt 41. More specifically, the regulating portion 463 extends along the outer face of the side wall portion 462 away from the fixing nip portion N toward the arc portion 452 of the belt guide 45, and then bends so as to protrude outward of the fixing belt 41 in the radial direction.

The regulating portion 463 has a protruding portion 4631 that protrudes away from the side wall portion 462. The protruding portion 4631 extends toward the belt guide 45. The protruding portion 4631 makes surface contact with, so as to overlap, the inner side (the side nearer to the arc portion 452) of the counter-face 4531 of the contact portion 453 of the belt guide 45. That is, the regulating portion 463 extends toward the belt guide 45, and makes surface contact with, so as to overlap, the counter-face 4531 of the contact portion 453.

With the structure described above, the regulating portion 463 of the frame member 46 makes surface contact with the counter-face 4531 of the contact portion 453 of the belt guide 45, and thereby restrains the arc portion 452 of the belt guide 45 from expanding unnecessarily far outward in the radial direction. In addition, the regulating portion 463 and the contact portion 453 in surface contact with each other can move smoothly relative to each other. The belt guide 45 can thus be deformed smoothly toward the fixing belt 41 and brought into proper contact with the inner circumferential face of the fixing belt 41.

In this embodiment, the fastening portion 451 of the belt guide 45 is disposed upstream of the fixing nip portion N in the belt rotation direction, and the contact portion 453 is disposed downstream of the fixing nip portion N in the belt rotation direction. Instead, their positions may be swapped.

As shown in FIGS. 2 and 4, the contact portion 453 of the belt guide 45 extends in a normal line direction from one end of the arc portion 452 in the circumferential direction. With this structure, the contact portion 453 is easily caught on the regulating portion 463, and the counter-face 4531 can easily move relative to the regulating portion 463.

Figure 5:
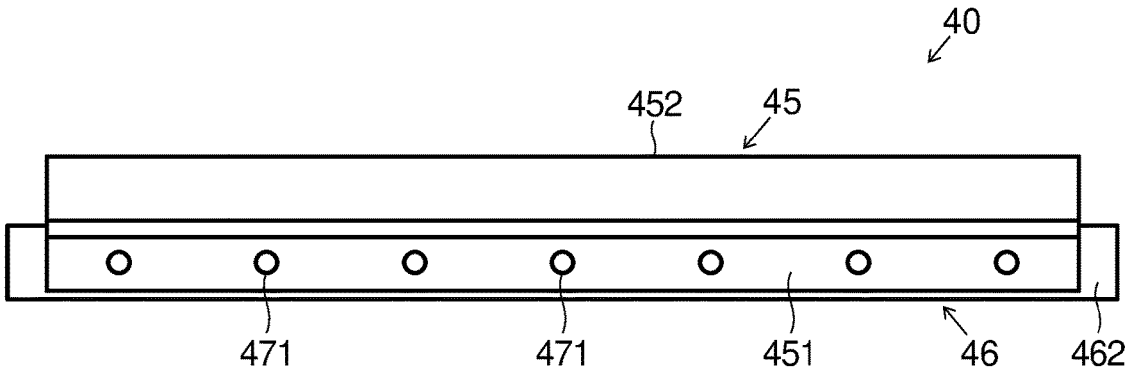
FIG. 5 is a side view of the fixing device according to the embodiment of the present disclosure, as seen from upstream of the fixing nip portion in the belt rotation direction.
Figure 6:
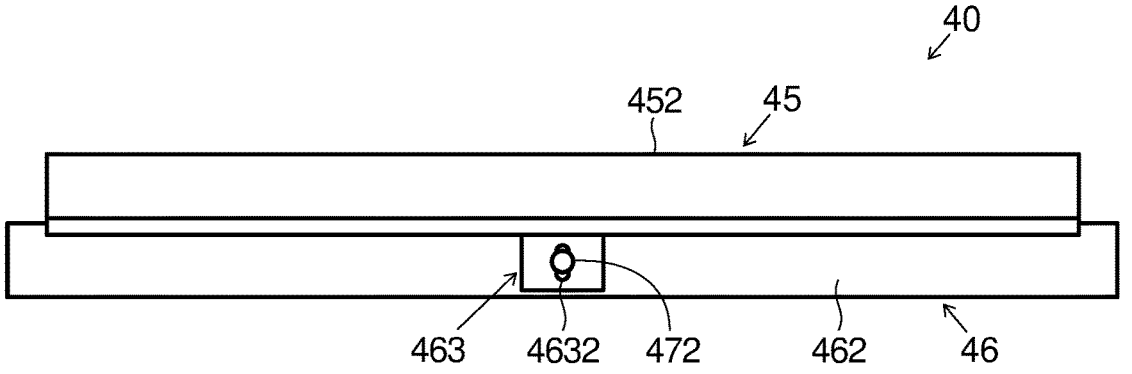
FIG. 6 is a side view of the fixing device according to the embodiment of the present disclosure, as seen from downstream of the fixing nip portion in the belt rotation direction.

FIG. 5 is a side view of the fixing device 40 as seen from upstream of the fixing nip portion N in the belt rotation direction. FIG. 6 is a side view of the fixing device 40 as seen from downstream of the fixing nip portion N in the belt rotation direction. In FIGS. 5 and 6, the components of the fixing device 40 other than the belt guide 45 and frame member 46 are omitted from illustration.

As shown in FIG. 5, the fastening portion 451 of the belt guide 45 is fastened, with a plurality of screws 471 arrayed along the rotation axis direction of the fixing belt 41 (the sheet width direction), to the outer face of the side wall portion 462 of the frame member 46. This helps keep the belt guide 45 stably in position.

As shown in FIG. 6, the regulating portion 463 of the frame member 46 is disposed in a middle part of it in the rotation axis direction of the fixing belt 41 (the sheet width direction). With this structure, the belt guide 45 can deform more freely. Thus, the arc portion 452 of the belt guide 45 can deform easily, and this helps enhance the closeness of contact with the fixing belt 41.

The regulating portion 463 is fastened, for example with one screw 472, to the outer face of the side wall portion 462 of the frame member 46. The regulating portion 463 has, for example, a positioning hole 4632. The positioning hole 4632 is configured as an elongate hole that extends in the direction (in FIG. 6, the up-down direction) in which the arc portion 452 of the belt guide 45 moves toward and away from the fixing belt 41. The positioning hole 4632 penetrates the regulating portion 463 in the direction (in FIG. 6, the front-rear direction) intersecting the rotation axis direction of the fixing belt 41.

The positioning hole 4632 has a width (length in the rotation axis direction of the fixing belt 41 (the sheet width direction; in FIG. 6, the left-right direction)) slightly greater than the diameter of the screw 472, and accommodates the screw 472. The regulating portion 463 is movable along the direction in which the positioning hole 4632, which is an elongate hole, extends, that is, along the direction in which the arc portion 452 moves toward and away from the fixing belt 41. This makes it possible to freely change the position of contact between the contact portion 453 of the belt guide 45 and the regulating portion 463 of the frame member 46.

Figure 7:
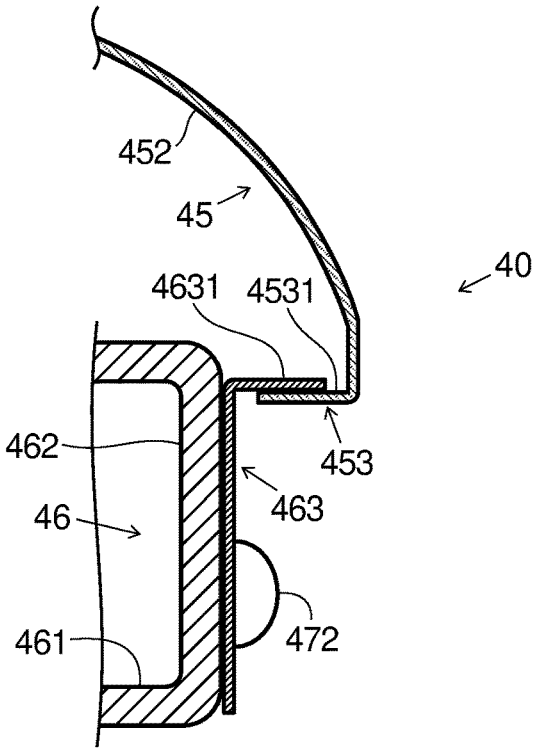
FIG. 7 is a partly sectional front view of the fixing device according to the embodiment of the present disclosure, showing a state where, without a fixing belt mounted on a belt guide, a contact portion and a regulating portion are in contact with each other.
Figure 8:
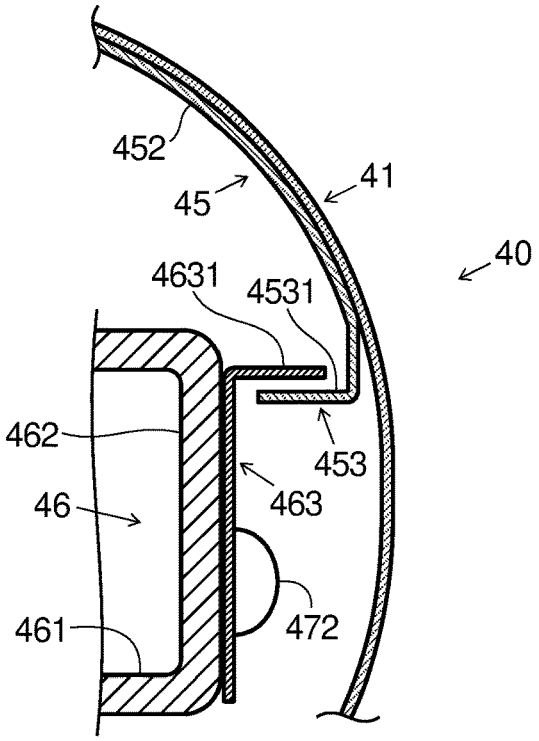
FIG. 8 is a partly sectional front view of the fixing device according to the embodiment of the present disclosure, showing a state where, with the fixing belt mounted on the belt guide, the contact portion and the regulating portion are apart from each other.

For example, the contact portion 453 of the belt guide 45 and the regulating portion 463 of the frame member 46 can make contact with and come apart from each other as the arc portion 452 of the belt guide 45 deforms elastically. FIG. 7 is a partly sectional front view of the fixing device 40, showing a state where, without the fixing belt 41 mounted on the belt guide 45, the contact portion 453 and the regulating portion 463 are in contact with each other. FIG. 8 is a partly sectional front view of the fixing device 40, showing a state where, with the fixing belt 41 mounted on the belt guide 45, the contact portion 453 and the regulating portion 463 are apart from each other.

Without the fixing belt 41 mounted on the belt guide 45, the arc portion 452 of the belt guide 45 is free from any external force, and tends to deform elastically to expand outward in the radial direction. As shown in FIG. 7, the belt guide 45 has the contact portion 453 caught on the regulating portion 463 of the frame member 46. More specifically, the counter-face 4531 of the contact portion 453 facing the inner circumferential face of the arc portion 452 is caught on the protruding portion 4631 of the regulating portion 463. Thus, the arc portion 452 is restrained from expanding outward in the radial direction beyond a predetermined size.

With the fixing belt 41 mounted on the belt guide 45, the fixing belt 41 makes contact with the outer circumferential face of the arc portion 452 of the belt guide 45, which thus deforms elastically and contracts inward in the radial direction. As a result, as shown in FIG. 8, the counter-face 4531 of the contact portion 453 facing the inner circumferential face of the arc portion 452 comes apart from the protruding portion 4631 of the regulating portion 463. Now the arc portion 452 over its entire area makes contact with the inner circumferential face of the fixing belt 41.

As described above, the contact portion 453 and the regulating portion 463 can be configured such that they can make contact with and come apart from each other as the arc portion 452 of the belt guide 45 deforms elastically. With this structure, without the fixing belt 41 mounted on the belt guide 45, the arc portion 452 does not expand outward in the radial direction beyond a predetermined size. This makes it easy to insert the nip forming member 43, the belt guide 45, and the frame member 46 inside the loop of the fixing belt 41. On the other hand, with the fixing belt 41 mounted on the belt guide 45, the contact portion 453 and the contact portion 453 are apart from each other. This makes it easy for the arc portion 452 to deform and make close contact with the inner circumferential face of the fixing belt 41.

While an embodiment of the present disclosure has been described above, it is in no way meant to limit the scope of the present disclosure, which can thus be implemented with any modifications made without departing from the spirit of the present disclosure.

For example, while the embodiment above deals with an example where the image forming apparatus 1 is a color-printing image forming apparatus of what is called a tandem-type that forms images of a plurality of colors sequentially while overlaying them on each other, it can instead be a color-printing image forming apparatus of other than a tandem type, or a monochrome-printing image forming apparatus.

What is claimed is:

1. A fixing device, comprising:

a fixing belt that is endless and that is rotatable along a conveying direction of a recording medium;

a pressing member that makes contact with an outer circumferential face of the fixing belt to give the fixing belt a rotating driving force;

a nip forming member that is disposed inward of the fixing belt so as to face the pressing member across the fixing belt and that makes contact with an inner circumferential face of the fixing belt to form a fixing nip portion;

a belt guide that makes contact with the inner circumferential face of the fixing belt at other than the nip portion to support the fixing belt from inward; and a frame member that holds the nip forming member and the belt guide, wherein the belt guide has:

a fastening portion that is fastened to the frame member at one side of the fixing nip portion in a belt rotation direction;

an arc portion that extends from the fastening portion while curving in an arc shape along the inner circumferential face of the fixing belt and that has an elastic force acting outward in a radial direction; and a contact portion that extends from one end of the arc portion in a circumferential direction at another side of the fixing nip portion in the belt rotation direction toward the frame member and that has a counter-face which faces an inner circumferential face of the arc portion, the frame member has a regulating portion that is fixed to a side wall portion of the frame member at the another side and that extends toward the belt guide to make surface contact with, so as to overlap, the counter-face of the contact portion, the regulating portion is disposed so as to face the contact portion of the belt guide and has a protruding portion that protrudes away from the side wall portion, and the protruding portion extends outward in the radial direction of the fixing belt with respect to the side wall portion and makes surface contact with, so as to overlap, the counter-face of the contact portion of the belt guide at an arc portion-side thereof.

2. The fixing device according to claim 1, wherein the contact portion extends in a normal line direction from one end of the arc portion in the circumferential direction.

3. The fixing device according to claim 1, wherein the contact portion and the regulating portion can make contact with and come apart from each other as the arc portion deforms elastically.

4. The fixing device according to claim 1, wherein the regulating portion is disposed in a middle part in a rotation axis direction of the fixing belt.

5. An image forming apparatus, comprising the fixing device according to claim 1.

* * * * *